US009427756B2

(12) United States Patent
Baranovski et al.

(10) Patent No.: US 9,427,756 B2
(45) Date of Patent: Aug. 30, 2016

(54) POWDER FEED ASSEMBLY FOR AN ENRICHED AIR FLAME SPRAY APPARATUS AND ASSOCIATED METHOD

(71) Applicants: Viacheslav E. Baranovski, Maidens, VA (US); Andrew V. Baranovski, Sandy Hook, VA (US)

(72) Inventors: Viacheslav E. Baranovski, Maidens, VA (US); Andrew V. Baranovski, Sandy Hook, VA (US)

( * ) Notice: Subject to any disclaimer, the term of this patent is extended or adjusted under 35 U.S.C. 154(b) by 36 days.

(21) Appl. No.: 14/613,318

(22) Filed: Feb. 3, 2015

(65) Prior Publication Data

US 2016/0221012 A1 Aug. 4, 2016

(51) Int. Cl.
*B05B 7/14* (2006.01)
*B05B 15/00* (2006.01)

(52) U.S. Cl.
CPC ..... *B05B 7/144* (2013.01); *B05B 15/003* (2013.01)

(58) Field of Classification Search
CPC ..... B05B 7/144; B05B 15/003
USPC ..... 222/410, 414, 342, 326, 1, 367, 333, 222/195, 334; 417/414; 406/146, 137, 52; 266/182; 164/200; 137/615, 14
See application file for complete search history.

(56) References Cited

U.S. PATENT DOCUMENTS 2,547,868 A * 4/1951 Judson ..... A01C 15/16 222/242
2,612,299 A * 9/1952 McCabe ..... C10B 31/04 222/367
3,001,829 A * 9/1961 De Saint-Martin .... B01J 8/0015 266/182
3,411,832 A * 11/1968 Garreau ..... B05B 7/144 406/125

FOREIGN PATENT DOCUMENTS

GB 2217691 A * 11/1989 ..... B65G 65/4836

* cited by examiner

*Primary Examiner* — Donnell Long
(74) *Attorney, Agent, or Firm* — Brian J. Teague

(57) ABSTRACT

A powder feed assembly comprises a powder hopper and a selectively rotating blade. The powder hopper has a wall and a floor together forming a chamber. A circumferential horizontal gap is defined between the wall and the floor to enable powder to exit the chamber. The selectively rotating blade has a body portion positioned within the chamber and one or more blade portions at least partially extending into the gap.

15 Claims, 8 Drawing Sheets

A (4:1)

A (4:1)

POWDER FEED ASSEMBLY FOR AN ENRICHED AIR FLAME SPRAY APPARATUS AND ASSOCIATED METHOD

FIELD OF THE INVENTION

The present invention relates generally to powder feeding, and more particularly to an apparatus and method for feeding powder to an enriched air flame spray apparatus.

BACKGROUND

Thermal spraying is widely used to apply metals and ceramics in a form of coating or bulk materials on different types of substrates. A majority of thermal spray methods utilize energy of hot gaseous jets to heat and accelerate particles of spraying material. When impinging the substrate, the particles form a coating.

The particles of material to be sprayed, such a metal or ceramic, are provided to the thermal spray apparatus as a powder. A powder feeding apparatus is used to provide a controlled amount of powder to the thermal spray apparatus. Conventional powder feeding apparatuses have several shortcomings, such as wearing seals and non-uniform powder metering. Wearing seals are a common feature of conventional powder feeding apparatus design, and necessitate frequent replacement of seals to prevent formation of gaps and maintain proper operation. When used with abrasive powders, some powder feeders require seal replacement as often as every few hours. This not only adds to operating costs, but also has a disadvantage of necessitating the removal of the powder feeder from service in order to perform the required maintenance, effectively shutting down the entire thermal spray coating application process until the powder feeder maintenance is performed. Another shortcoming of conventional powder feeding apparatus design is the pulsation of the powder stream, which results from discrete metering of the powder material. Conventional metering mechanisms generally utilize slots or holes of fixed volume, into which the powder material is packed, and from which the powder material is dispensed into the powder stream in batches, resulting in a non-uniform powder stream.

BRIEF SUMMARY

In one embodiment of the invention, a powder feed assembly for an enriched air flame spray apparatus comprises a powder feed assembly comprises a powder hopper and selectively rotating blade. The powder hopper has a wall and a floor together forming a chamber. A circumferential horizontal gap is defined between the wall and the floor to enable powder to exit the chamber. The selectively rotating blade has a body portion positioned within the chamber and one or more blade portions at least partially extending into the gap.

A height of the gap and/or a width of a portion of the floor which extends circumferentially beyond an interior surface of the wall adjacent the gap may be selected based on an angle of repose of the powder.

A height of the gap and/or a width of a portion of the floor which extends circumferentially beyond an interior surface of the wall adjacent the gap may be selected such that the powder does not exit the chamber through the gap when the blade is not spinning.

A height of the gap and/or a width of a portion of the floor which extends circumferentially beyond an interior surface of the wall adjacent the gap may be selected such that the width of the portion of the floor which extends circumferentially beyond the interior surface of the wall adjacent the gap may be greater than a distance that the powder extends into the gap beyond the interior surface of the wall adjacent the gap when the blade is not spinning. The distance that the powder extends into the gap beyond the interior surface of the wall adjacent the gap may correspond to an angle of repose of the powder.

The assembly may further comprise a motor and a motor housing. The motor may be positioned beneath the floor and has a selectively rotating shaft to which the blade is directly or indirectly affixed. The shaft may extend at least partially through a shaft hole defined in the floor. The motor housing may at least partially surround the motor and may have a carrier gas inlet to enable a carrier gas to be introduced into the motor housing to pressurize the housing.

The assembly may further comprise a receiving funnel positioned to receive powder exiting the chamber through the gap and to supply the received powder to a hose.

The assembly may further comprise a pressure-equalizing pipe fluidly connecting the chamber and the receiving funnel to enable pressure equalization therebetween.

At least a portion of the hopper wall may be porous. The porous portion may have a plurality of holes defined therein, a size of the holes selected to permit a carrier gas to exit the chamber through the porous portion but to not permit the powder to exit the chamber through the porous portion. The porous portion may be positioned between the chamber and an inner volume of the receiving funnel.

The assembly may further comprise a porous bushing having a plurality of holes defined therein, a size of the holes selected to permit a carrier gas to exit the chamber through the porous bushing but to not permit the powder to exit the chamber through the porous bushing. The porous bushing may be positioned between the chamber and an inner volume of the receiving funnel.

In addition to powder feed assembly for an enriched air flame spray apparatus, as described above, other aspects of the present invention are directed to corresponding methods for feeding powder.

BRIEF DESCRIPTION OF THE SEVERAL VIEWS OF THE DRAWING(S)

Reference is made herein to the accompanying drawings, which are not necessarily drawn to scale, and wherein:

FIG. 1 is a cross-sectional side view of a powder feeding apparatus, in accordance with embodiments of the invention.

FIG. 1*a* is an enlarged view of a central portion of the powder feeding apparatus of FIG. 1.

DETAILED DESCRIPTION

Embodiments of the invention comprise a powder feeding apparatus. A powder feeding apparatus of embodiments of the invention may be used to supply powder to a thermal spray apparatus, although embodiments of the invention are not limited to use with thermal spray apparatuses.

Figure 1:
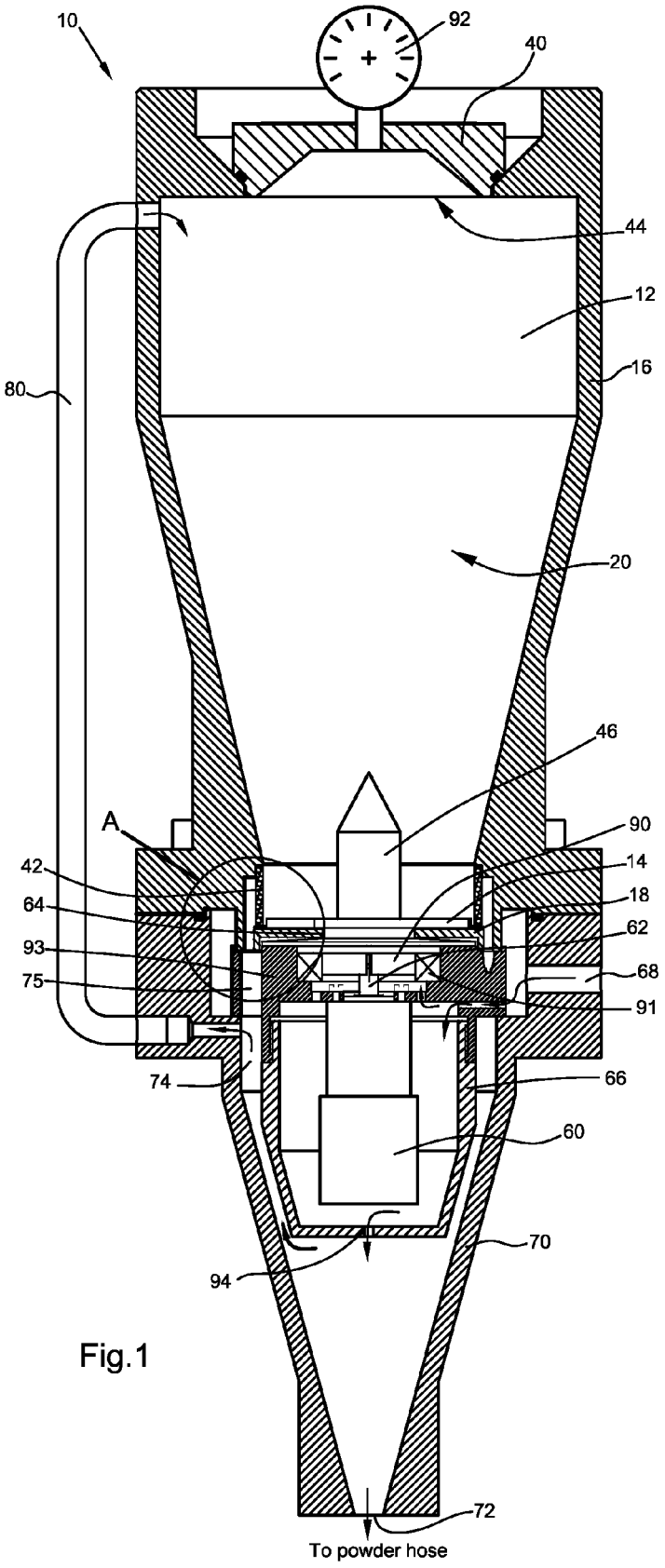

Referring now to FIGS. 1-8, a powder feed assembly 10 comprises a powder hopper 12 and a selectively rotating blade 14. The hopper 12 has a wall 16 and a floor 18 together forming a chamber 20 for holding a powder to be fed to, for example, a thermal spray apparatus (the powder is omitted from FIGS. 1, 1*a*, and 4-8 for clarity). As seen in FIG. 1, the wall 16 has a generally vertical upper portion, a generally conical middle portion, and a generally vertical lower portion, although other suitable shape profiles may be used. A circumferential horizontal gap 22 (seen in FIGS. 2 and 3) is defined between the wall 16 and the floor 18 to enable powder to exit the chamber. An opening 44 is defined in the top of the hopper 12 for adding powder into the hopper. The opening 44 is selectively closed off via selectively removable cap 40. A pressure gauge 92 may be attached to a port defined in the cap 40, for measuring the pressure within the chamber 20.

The selectively rotating blade 14 has a body portion positioned wholly within the chamber and one or more blade portions at least partially extending into the gap 22 (and potentially extending all the way through the gap). Having one or more blade portions at least partially extending into the gap enables the blade to push powder that is within the chamber 20 out through the gap 22 in a consistent and controlled manner. The rotational speed of the blade can be varied as needed to increase or decrease the amount of powder that is pushed out through the gap 22. The selectively rotating blade may be constructed out of any suitable material, such as any suitable metal or metal alloy. It may be desirable for at least the blade portions to be constructed out of a softer, more flexible material (including but not limited to rubber) which may help prevent powder particles from becoming wedged between the blade portions and the surface(s) of the gap 22.

Figure 5:
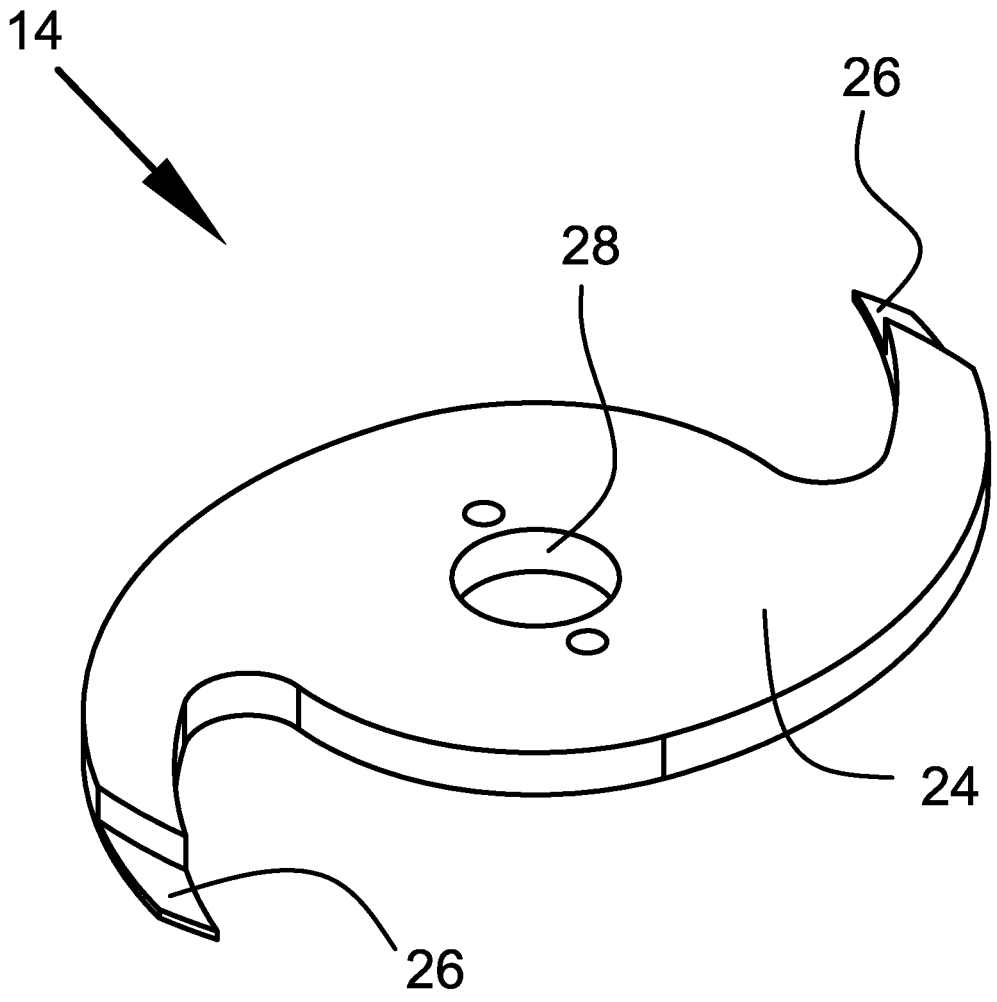
FIG. 5 is a perspective view of the blade of the powder feeding apparatus of FIG. 1.
Figure 6:
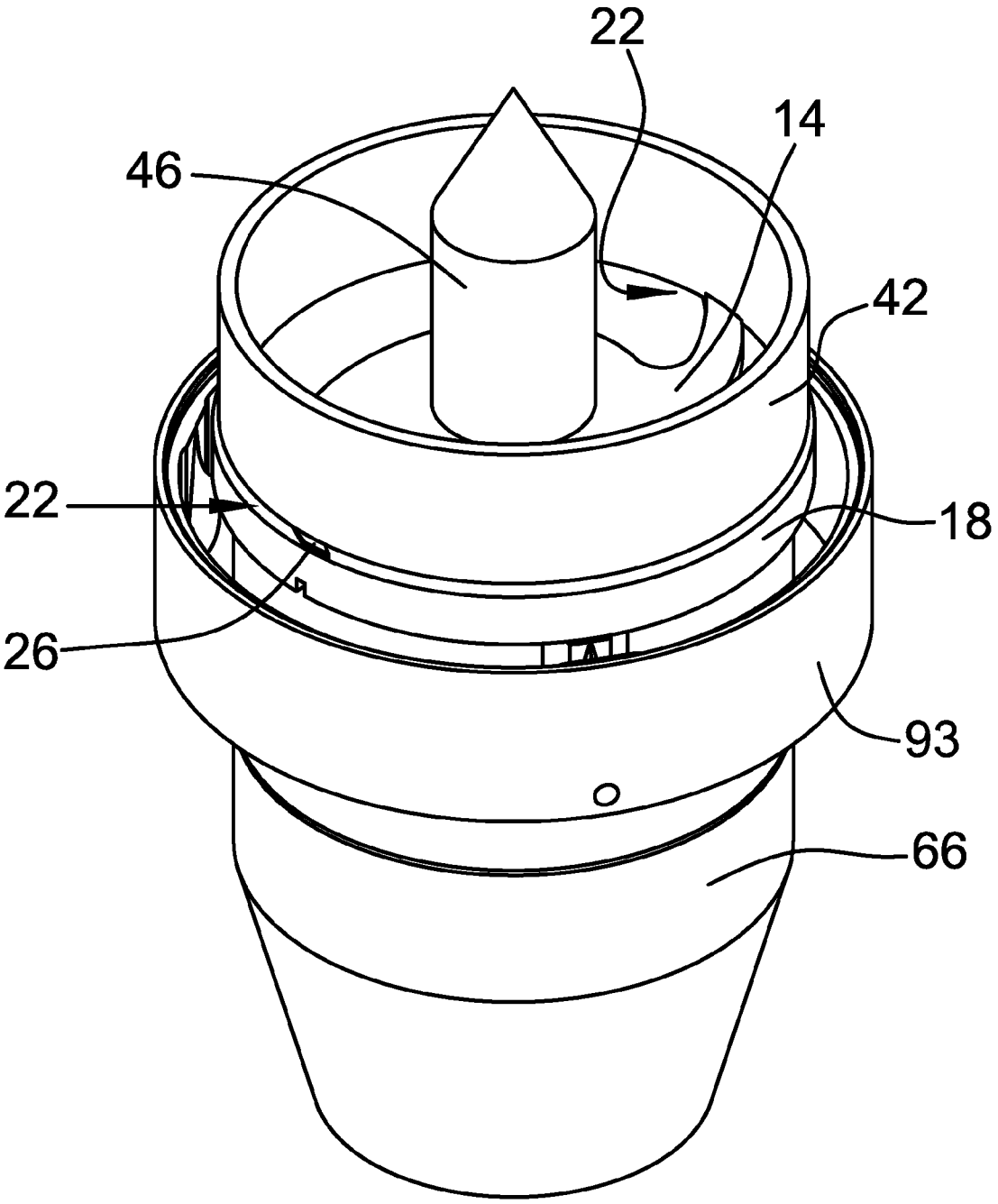
FIG. 6 is a perspective view of the feeding mechanism of the powder feeding apparatus of FIG. 1.
Figure 7:
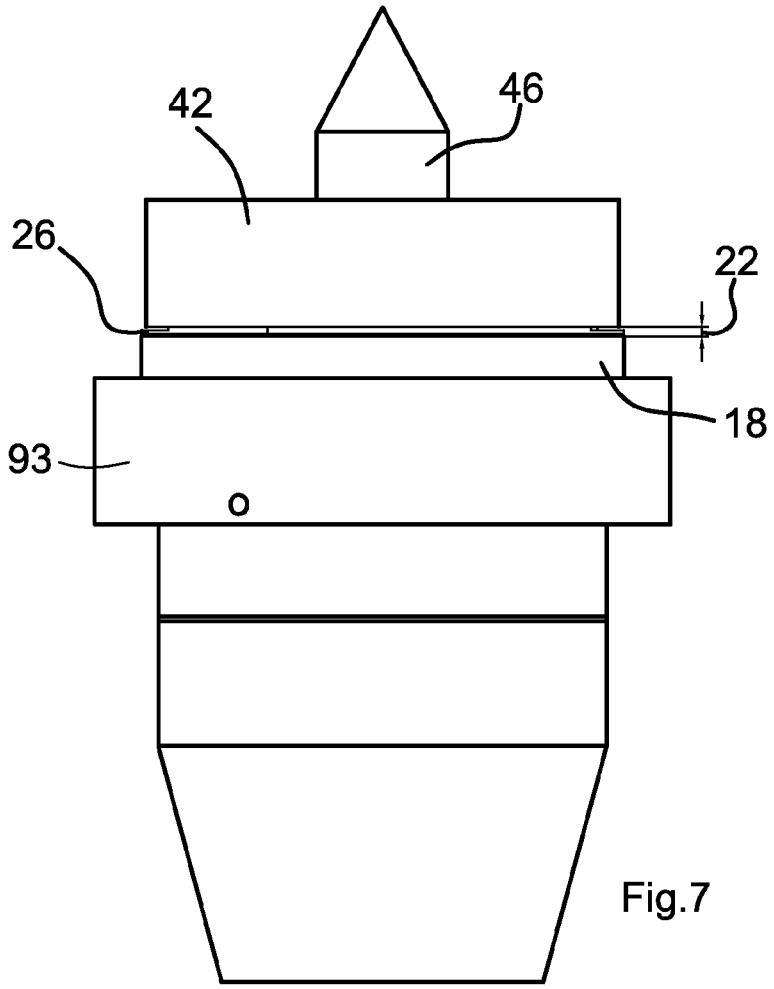
FIG. 7 is a side view of the feeding mechanism of the powder feeding apparatus of FIG. 1.
Figure 8:
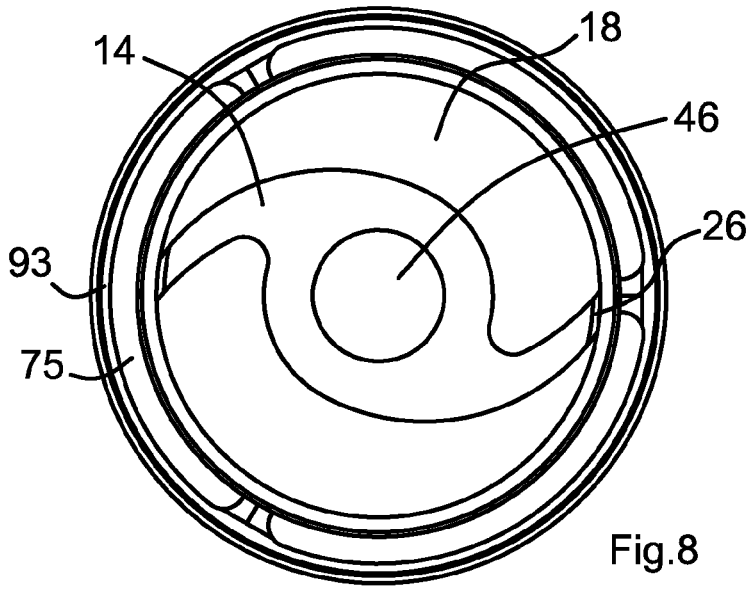
FIG. 8 is a top view of the feeding mechanism of the powder feeding apparatus of FIG. 1.

FIG. 5 illustrates one embodiment of the blade that may be used with a powder feed assembly of embodiments of the invention. Blade 14 of FIG. 5 has a body portion 24 and two opposing blade portions 26 (the blade portions 26 may also be termed "arms"). It is desirable to have the body portion 24 to be thicker than blade portions 26 for better agitation of powder and preventing the powder from bridging in the chamber 20 when the blade is spinning. Blade 14 also has a center hole 28 defined therein for attaching the blade 14 to a motor shaft (described below). While FIG. 5 illustrates a blade having two blade portions or arms, blades of alternative embodiments of the invention may alternatively have one blade portion or may have more than two blade portions. The blade portion(s) extending into the gap 22 is seen at least in FIGS. 3, 6, 7 and 8.

A nut 46 is affixed to the motor shaft to secure the blade in place. The nut 46 has an elongated vertical shape with a conical top. The shape of the nut 46 helps direct powder within the chamber 20 toward the wall 16 of the chamber, to better facilitate the blade pushing the powder through the gap 22.

The hopper 12 may include a porous bushing 42 having a plurality of holes defined therein. The size of the holes is selected such that a carrier gas (discussed further below) is able to exit the chamber 20 through the porous bushing but such that the powder is not able to exit the chamber 20 through the porous bushing. In other words, the holes in the porous bushing are larger than the molecules of the carrier gas but smaller than the particles of the powder. The number of holes (which may be controlled by the size of the porous bushing) may be selected to enable the amount of carrier gas exiting in that manner to be controlled. When the hopper is under pressure, the carrier gas is within the powder mass in addition to being above or below powder. When the spray gun is stopped, this gas within the powder starts releasing pressure by flowing out through all possible holes (which, in the absence of the porous bushing would be just the gap 22) and then out through the powder hose. Obviously, this flow of carrier gas drags powder through the gap 22, which creates undesirable powder after-flow through the spray gun, resulting in wasted powder. The porous bushing minimizes or prevents this by providing multiple passages for gas to escape to release pressure but not allowing powder to flow through holes. Some carrier gas will still flow through the gap 22, but the gas flow through the gap 22 becomes small enough that it does not entrain the powder through the gap).

The height of the gap 22 (dimension "B" in FIG. 2) and/or the width of the portion of the floor 18 which extends circumferentially beyond the interior surface of the hopper (formed by the porous bushing 42) adjacent the gap (dimension "D" in FIG. 2) may vary depending on the angle of repose of the powder to be fed. Dimension "B" and/or dimension "D" is/are selected such that the powder does not exit the chamber through the gap 22 when the blade is not spinning. One way to accomplish this is to ensure that dimension "B" and/or dimension "D" is/are selected such that dimension "D" is greater than a distance that the powder extends into the gap 22 beyond the interior surface of the wall adjacent the gap (dimension "E" in FIG. 2) when the blade is not spinning. The difference between dimension "E" and dimension "D" is labeled as dimension "C" in FIG. 2.

Figure 2:
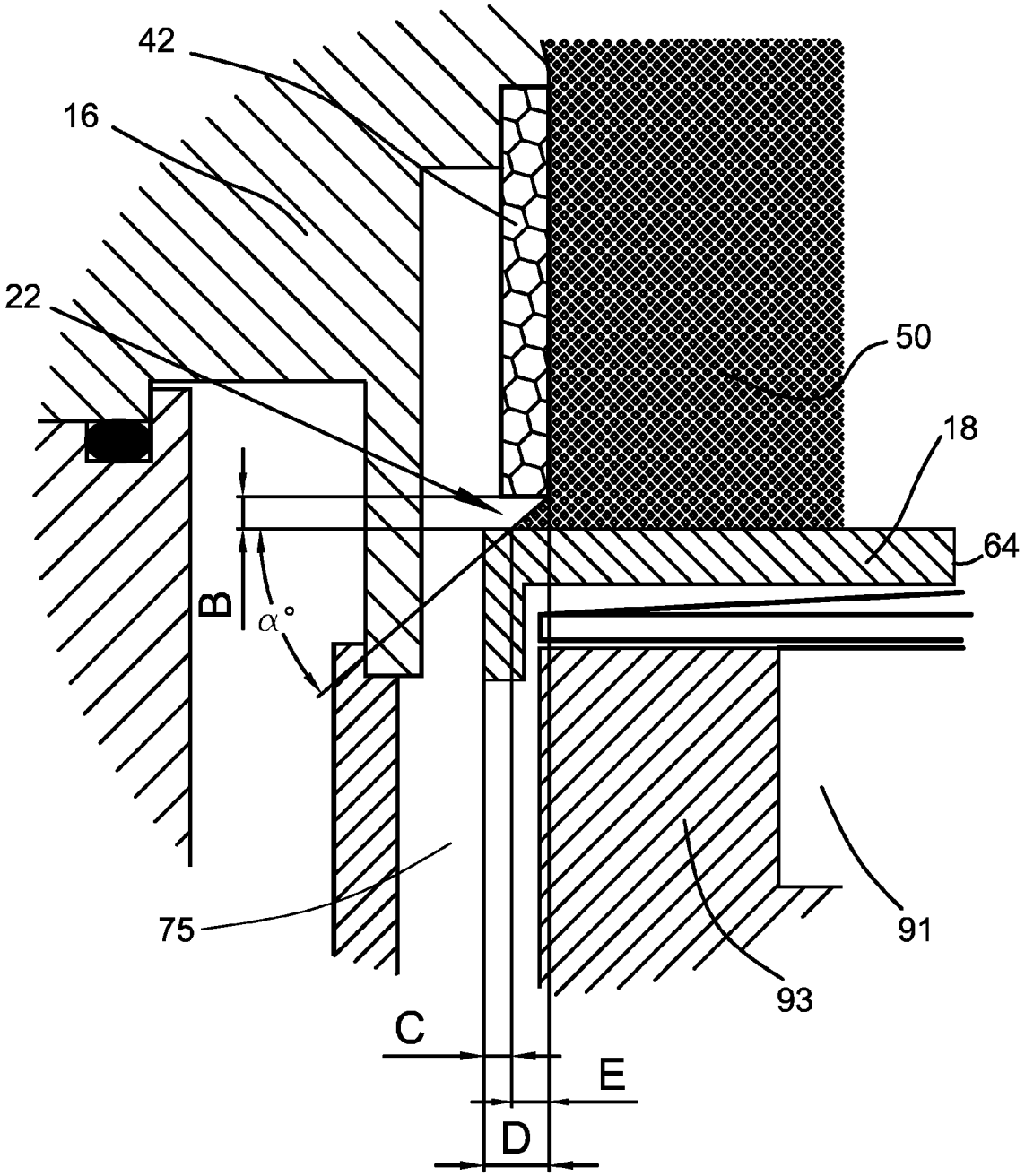
FIG. 2 is a first enlarged view of a first section (marked "A" in FIG. 1) of the powder feeding apparatus of FIG. 1, with the blade omitted for simplicity.
Figure 3:
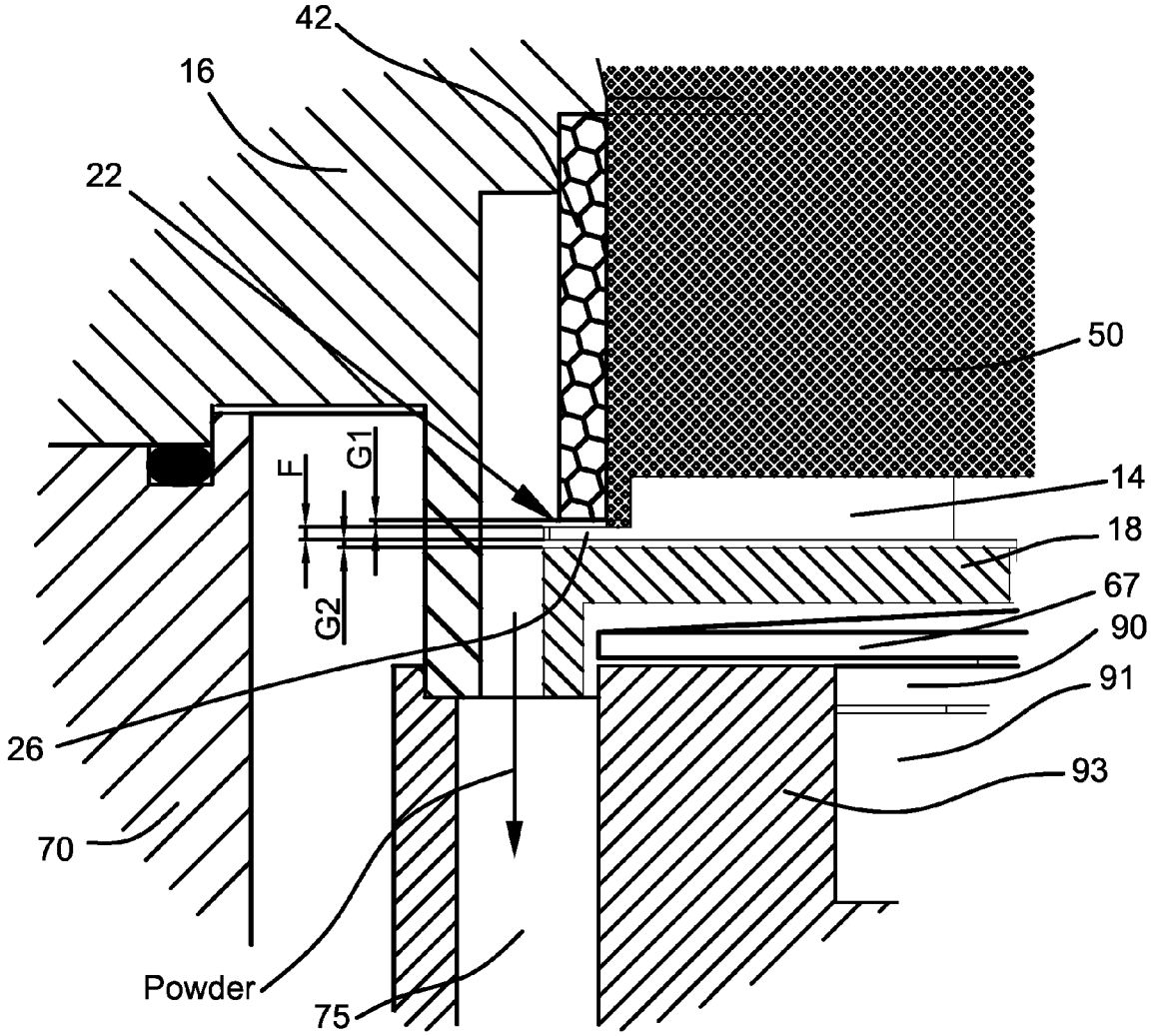
FIG. 3 is a second enlarged view of the first section (marked "A" in FIG. 1) of the powder feeding apparatus of FIG. 1.
Figure 4:
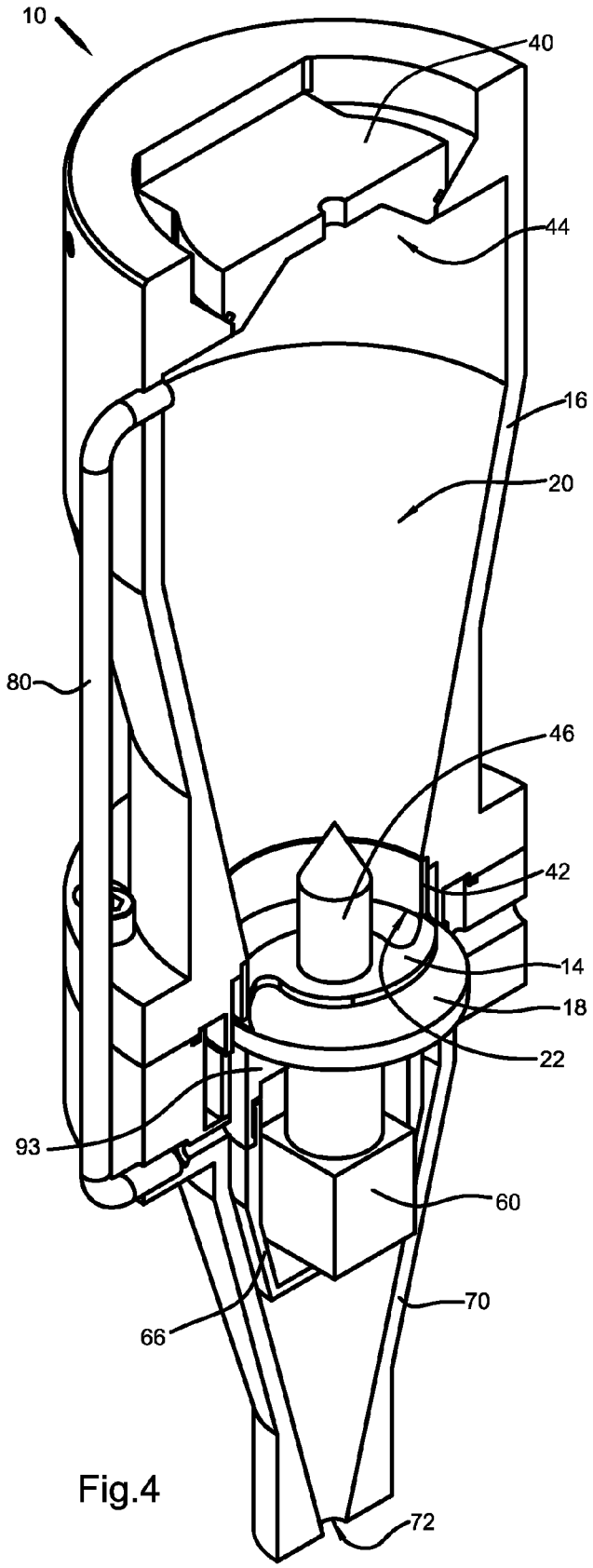
FIG. 4 is a cross-sectional perspective view of the powder feeding apparatus of FIG. 1.

The distance that the powder extends into the gap beyond the interior surface of the hopper (which is formed by the porous bushing 42 in the illustrated embodiment, or by the wall 16 if no porous bushing is used) adjacent the gap when the blade is not spinning (dimension "E" in FIG. 2) corresponds to an angle of repose of the powder. Angle of repose is the steepest angle of descent relative to the horizontal plane in which a material can be piled without slumping. The angle of repose of powder 50 in FIG. 2 is labeled "$\alpha°$". The angle of repose of the powder 50 determines how far past the interior surface of the hopper (which in the illustrated embodiment is actually the interior surface of the porous bushing 42) the powder 50 will naturally fall (dimension "E" in FIG. 2). The taller the gap 22 is (dimension "B" in FIG. 2), the farther past the interior surface of the hopper the powder 50 will naturally fall (dimension "E" in FIG. 2) and therefore the wider the portion of the floor 18 which extends circumferentially beyond the interior surface of the hopper adjacent the gap (dimension "D" in FIG. 2) should be. Conversely, the shorter the gap 22 is (dimension "B"), the less far past the interior surface of the hopper the powder 50 will naturally fall (dimension "E") and therefore the less wide the portion of the floor 18 which extends circumferentially beyond the interior surface of the hopper adjacent the gap (dimension "D" in FIG. 2) should be. The height of the gap 22 (dimension "B" in FIG. 2) is typically selected (along with the thickness of the blade portion and relative position of the blade portion within the gap—discussed further below) to ensure that the desired amount of powder is fed from the chamber 20 during operation of the powder feed assembly 10. It is typically known which powder(s) will be used in the powder feed assembly 10, and therefore the angle(s) of repose is/are typically known. As such, the width of the portion of the floor 18 which extends circumferentially beyond the interior surface of the hopper adjacent the gap (dimension "D" in FIG. 2) would typically be determined based on the gap height and the shallowest angle of repose for whichever powder(s) will be used in the powder feed assembly 10.

The thickness of the blade portion 26 (dimension "F" in FIG. 3), the height of the gap 22 (dimension "B" in FIG. 2), and the position of the blade portion 26 within the gap 22 are all selected such that gap above the blade portion (dimension "G1" in FIG. 3) and the gap below the blade portion (dimension "G2" in FIG. 3) are both larger than the largest particle of powder expected to be fed using the powder feed assembly of embodiments of the invention.

Figure 1A:
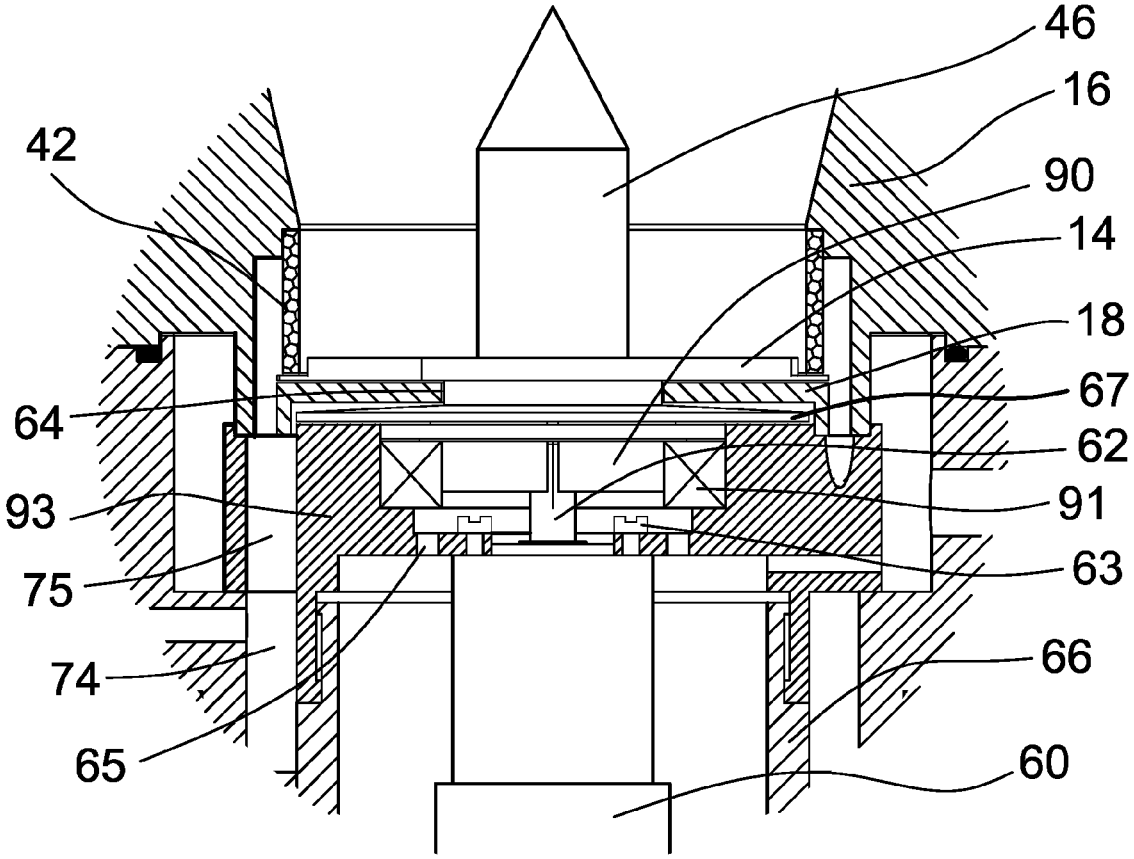

The powder feed assembly of embodiments of the invention further comprises a motor 60 positioned beneath the floor 18 and attached to motor housing base 93 with screws 63. The electrical and control connections to the motor 60 are omitted from the figures for simplicity. The motor 60 has a selectively rotating shaft 62 to which the blade 14 is affixed (directly or indirectly). The shaft 62 extends at least partially through a shaft opening defined in the floor 18. In the illustrated embodiment, as seen in FIG. 1*a*, the motor shaft 62 actually is attached to a blade holder 90 that is sitting on a bearing 91. The blade is affixed to the blade holder 90. Such an indirect connection between the blade and the motor shaft is desirable to minimize/eliminate the axial run out of the blade and secure its position in the gap. The blade holder 90 may have a deflector portion 67 that helps prevent powder (that may fall from the chamber 20 through the opening 64) from getting into the bearing 91 and motor 60.

The motor 60 is at least partially surrounded by a motor housing 66. The motor housing 66 is affixed to the motor housing base 93 below the floor 18. In conventional powder feed devices, the carrier gas is introduced into a powder hopper to propel the powder within the hopper through a screened floor. The carrier gas carries the powder particles from the hopper all the way to the thermal spray apparatus. It is necessary in conventional powder feed devices to seal the opening through which the motor shaft extends, such as with a gasket, to try to prevent the powder from reaching the motor itself. Some powders are abrasive and can damage the motor, and therefore it is desirable to keep the powder away from the motor. However, it is difficult to obtain a proper seal, and therefore it is difficult to keep powder from reaching the motor in a conventional powder feed device.

The powder feed assembly of embodiments of the invention further comprises a carrier gas inlet 68 to enable a carrier gas to be introduced into the motor housing 66 to create a positive pressure within the motor housing to prevent powder from entering the motor housing. A carrier gas supply hose (not illustrated) would be affixed to the carrier gas inlet 68 and to a carrier gas supply tank (not illustrated). The carrier gas exits the motor housing 66 through a carrier gas outlet 94 defined in the bottom of the motor housing 66. Some of the carrier gas also exits the motor housing 66 and enters the chamber 20 via the shaft openings 64 and openings 65 in the motor housing base 93 (as well as exiting the motor housing 66 through any other gaps in the motor housing base 93). The path of the carrier gas is illustrated by the arrows in FIG. 1. Using the carrier gas to pressurize the motor housing 66 helps prevent powder from entering the motor housing 66 and reaching the motor 60. Such an arrangement eliminates the need to seal the motor shaft opening and is therefore superior to conventional powder feed devices.

The powder feed assembly of embodiments of the invention further comprise a receiving funnel 70 positioned to receive powder exiting the chamber 20 through the gap 22. A powder outlet 72 is defined in the bottom end of the receiving funnel 70 to direct the powder to a hose (not illustrated) that is connected to the powder outlet 72. The hose in turn is connected to a thermal spray apparatus (not illustrated). During operation, powder that is pushed out of the chamber 20 by the blade falls into the circumferential slots 75 in the motor housing base 93 and further into a circumferential channel 74 defined between the receiving funnel 70 and the motor housing 66 and then into the receiving funnel 70 and out of the receiving funnel through the hose connected to the thermal spray apparatus. The carrier gas propels the powder all the way to the thermal spray apparatus.

A pressure-equalizing pipe 80 fluidly connects the chamber 20 and the receiving funnel 70 to enable pressure equalization therebetween.

In operation of the powder feed assembly of embodiments of the invention, a powder to be fed to a thermal spray apparatus (or any other suitable apparatus) is placed into the chamber 20 of the powder hopper 12 of the powder feed assembly 10, via opening 44. The motor 60 is activated, which rotates blade 14. The rotating blade pushes powder out of the chamber 20 through the gap 22, and the powder falls into the receiving funnel 70. A carrier gas (not illustrated) is introduced into the motor housing 66 via the carrier gas inlet 68. The carrier gas exits the motor housing 66 into the receiving funnel 70, as well as into the chamber 20 via the openings 64 and 65. The carrier gas travels with the powder out of the receiving funnel 70 and into the hose (not illustrated). Some of the carrier gas also travels between the receiving funnel 70 and the chamber 20 via the pressure-equalizing pipe 80.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

That which is claimed:

1. A powder feed assembly comprising:

a powder hopper having a wall and a floor together forming a chamber, a circumferential horizontal gap being defined between the wall and the floor to enable powder to exit the chamber;

a selectively rotating blade having a body portion positioned within the chamber and one or more blade portions at least partially extending into the gap;

a receiving funnel positioned to receive powder exiting the chamber through the gap and to supply the received powder to a hose; and a porous bushing having a plurality of holes defined therein, a size of the holes selected to permit a carrier gas to exit the chamber through the porous bushing but to not permit the powder to exit the chamber through the porous bushing, the porous bushing being positioned between the chamber and an inner volume of the receiving funnel.

2. The assembly of claim 1, wherein (a) a height of the gap and/or (b) a width of a portion of the floor which extends circumferentially beyond an interior surface of the wall adjacent the gap is selected based on an angle of repose of the powder.

3. The assembly of claim 1, wherein (a) a height of the gap and/or (b) a width of a portion of the floor which extends circumferentially beyond an interior surface of the wall adjacent the gap is selected such that the powder does not exit the chamber through the gap when the blade is not spinning.

4. The assembly of claim 1, wherein (a) a height of the gap and/or (b) a width of a portion of the floor which extends circumferentially beyond an interior surface of the wall adjacent the gap is selected such that the width of the portion of the floor which extends circumferentially beyond the interior surface of the wall adjacent the gap is greater than a distance that the powder extends into the gap beyond the interior surface of the wall adjacent the gap when the blade is not spinning.

5. The assembly of claim 4, wherein the distance that the powder extends into the gap beyond the interior surface of the wall adjacent the gap corresponds to an angle of repose of the powder.

6. The assembly of claim 1, further comprising:

a motor positioned beneath the floor and having a selectively rotating shaft to which the blade is directly or indirectly affixed, the shaft extending at least partially through a shaft hole defined in the floor; and a motor housing at least partially surrounding the motor and having a carrier gas inlet to enable a carrier gas to be introduced into the motor housing to pressurize the housing.

7. The assembly of claim 1, further comprising:

a pressure-equalizing pipe fluidly connecting the chamber and the receiving funnel to enable pressure equalization therebetween.

8. The assembly of claim 1, wherein at least a portion of the hopper wall is porous, the porous portion having a plurality of holes defined therein, a size of the holes selected to permit a carrier gas to exit the chamber through the porous portion but to not permit the powder to exit the chamber through the porous portion, the porous portion being positioned between the chamber and an inner volume of the receiving funnel.

9. A method of feeding powder comprising:

placing a desired amount of a powder into a powder hopper of a powder feed assembly, the powder hopper having a wall and a floor together forming a chamber, a circumferential horizontal gap being defined between the wall and the floor to enable at least some of the powder to exit the chamber;

selectively rotating a blade of the powder feed assembly to cause at least some of the powder to exit the chamber through the gap, the blade having a body portion positioned within the chamber and one or more blade portions at least partially extending into the gap;

receiving, into a receiving funnel, powder exiting the chamber through the gap;

supplying the received powder to a hose; and equalizing the pressure between the receiving funnel and the chamber using a pressure-equalizing pipe fluidly connecting the chamber and the receiving funnel;

wherein the powder feed assembly further comprises a porous bushing having a plurality of holes defined therein, a size of the holes selected to permit a carrier gas to exit the chamber through the porous bushing but to not permit the powder to exit the chamber through the porous bushing, the porous bushing being positioned between the chamber and an inner volume of the receiving funnel.

10. The method of claim 9, wherein (a) a height of the gap and/or (b) a width of a portion of the floor which extends circumferentially beyond an interior surface of the wall adjacent the gap is selected based on an angle of repose of the powder.

11. The method of claim 9, wherein (a) a height of the gap and/or (b) a width of a portion of the floor which extends circumferentially beyond an interior surface of the wall adjacent the gap is selected such that the powder does not exit the chamber through the gap when the blade is not spinning.

12. The method of claim 9, wherein (a) a height of the gap and/or (b) a width of a portion of the floor which extends circumferentially beyond an interior surface of the wall adjacent the gap is selected such that the width of the portion of the floor which extends circumferentially beyond the interior surface of the wall adjacent the gap is greater than a distance that the powder extends into the gap beyond the interior surface of the wall adjacent the gap when the blade is not spinning.

13. The method of claim 12, wherein the distance that the powder extends into the gap beyond the interior surface of the wall adjacent the gap corresponds to an angle of repose of the powder.

14. The method of claim 9, further comprising:

activating a motor positioned beneath the floor such that a selectively rotating shaft of the motor is rotated which in turn rotates the blade which is affixed directly or indirectly to the shaft, the shaft extending at least partially through a shaft hole defined in the floor; and introducing a carrier gas into a motor housing that at least partially surrounds the motor, thereby pressurizing the motor housing.

15. The method of claim 9, wherein at least a portion of the hopper wall is porous, the porous portion having a plurality of holes defined therein, a size of the holes selected to permit a carrier gas to exit the chamber through the porous portion but to not permit the powder to exit the chamber through the porous portion, the porous portion being positioned between the chamber and an inner volume of the receiving funnel.

* * * * *